US012228288B1

(12) United States Patent
Wittenberg et al.

(10) Patent No.: US 12,228,288 B1
(45) Date of Patent: Feb. 18, 2025

(54) HEATSAVER

(71) Applicants: Paul Wittenberg, San Ramon, CA (US); Mark Gradwohl, San Ramon, CA (US)

(72) Inventors: Paul Wittenberg, San Ramon, CA (US); Mark Gradwohl, San Ramon, CA (US)

(73) Assignee: Paul Wittenberg, San Ramon, CA (US)

( * ) Notice: Subject to any disclaimer, the term of this patent is extended or adjusted under 35 U.S.C. 154(b) by 197 days.

(21) Appl. No.: 17/574,593

(22) Filed: Jan. 13, 2022

(51) Int. Cl.
*F24B 1/195* (2006.01)

(52) U.S. Cl.
CPC ..... *F24B 1/1957* (2013.01)

(58) Field of Classification Search
CPC ..... F24B 1/1957
See application file for complete search history.

(56) References Cited

U.S. PATENT DOCUMENTS

| | | | | |
|---|---|---|---|---|
| 3,537,388 | A * | 11/1970 | Martin | A47J 37/0763 126/30 |
| 5,263,468 | A * | 11/1993 | Powell | A61F 7/00 126/696 |
| D383,029 | S * | 9/1997 | Strelcheck, Jr. | D7/332 |
| 11,859,827 | B1 * | 1/2024 | Redlinski | F24B 1/1957 |
| 11,920,798 | B2 * | 3/2024 | Weilert | F24B 3/00 |
| 2013/0167835 | A1 * | 7/2013 | Zhu | F24C 15/22 126/91 R |
| 2018/0156466 | A1 * | 6/2018 | Spalding | F24B 1/1957 |

* cited by examiner

*Primary Examiner* — David J Laux

(57) ABSTRACT

The present invention relates to an enhanced design of a HeatSaver which improves the effectiveness of your gas fire pit by redistributing the heat laterally towards those sitting around gas fire pit. HeatSaver which is versatile, with leg attachment locations and leg extensions that allow HeatSaver to work in a variety of operating environments. The dish can be tilted to provide more directional heat, raised/lowered to match heating needs, used in a convex or concave fashion, and can act as a cover for your gas fire pit when not in use.

10 Claims, 7 Drawing Sheets

HEATSAVER

COPYRIGHT NOTICE

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Field of the Invention

The present invention concerns a heat distribution device. It finds particular application on a convex dish made of metal, generally aluminum given its higher emissivity, or stainless steel, which sits above a gas fire pit in order to redirect the heat laterally to those sitting around the gas fire pit.

Description of the Related Art

There are several tens of millions of residences in the United States (and many scores of millions of residences throughout the world) that have gas fire pits for outdoor heating and for enjoyment.

Various efforts have been made to render a gas fire pit more efficient for heating purposes. Such efforts include permanently installed heat exchange devices with air circulation means incorporated therein which are rather expensive in their initial cost and either must be installed when the gas fire pit is built or require substantial modification of the gas fire pit. In addition, efforts have been made to place a heat exchange device in the gas fire pit and circulate air through it for heating the air. Furthermore, in the case of outdoor event, people sitting around a gas fire pit need better heat distribution to keep themselves warm.

There are multiple inventions that have been proposed in prior art regarding advancements in similar domain. For instance, a Heating apparatus for arranging under a table bearing U.S. patent Ser. No. 10,648,696B2 is issued to KSS MADE HOLDING. The patent invention relates to an electrical heating apparatus for arranging under a table, the heating apparatus comprising a housing, at least one electrically powered heat source arranged inside said housing, and heat shielding means comprised in the housing and having a plurality of through holes configured for allowing heat radiation from the electrically powered heat source to pass, wherein the heat shielding means comprises a layer of a material with a thermal conductivity lower than 2 [W·m−1·K−1], and wherein the inner surface of the heat shielding means is applied with a layer of heat radiation reflecting material configured for reflecting the heat radiated from the heat source back against the inner part of the housing.

Another patent on Modular fire pit table bearing U.S. Pat. No. 9,138,099B2 is issued to Sunil Kumar DhuperGreg Marler. The patent in one embodiment, relates to a fire pit table apparatus includes a base having a ground contacting portion. The apparatus also includes a table assembly coupled to the base. The table assembly includes a table top for placement of one or more objects. The table top has an opening formed therein. The apparatus also includes a fire bowl assembly that is disposed within the opening of the table top such that the table top surrounds at least a portion of the fire bowl assembly and provides access to the fire bowl assembly. The fire bowl assembly includes a fire bowl and a hot top member that is disposed around the fire bowl. The hot top member includes a planar surface on which one or more objects can be placed, wherein the fire bowl and the hot top member are rotatably coupled to the table assembly to permit rotation of the fire bowl assembly relative to the table assembly.

A patent on High efficiency infrared radiant energy heating system and reflector therefor bearing U.S. Pat. No. 4,727,854A is issued to Arthur C. W. Johnson. The patent is on an insulated reflector for a low-intensity radiant energy heating system. Several embodiments are disclosed. In one embodiment, the reflector forms a chamber which is used to preheat fresh air admitted to the heated area.

Another patent on Terrace heater bearing U.S. patent 20100132698A1 is issued to FRISGAARD WENG APS. The patent is on a terrace heater, including a base cabinet intended for storage of a supply of gas, which is connected to a burner at the free end of a support part extending upright from the cabinet. On the upwardly-facing free end of the burner, there is a reflector including an annular first screen which has a lower edge and extends outwards and at an angle downwards over the periphery of the burner for an inclined and downwardly-directed reflection of heat emitted from the burner along the edge of the reflector. Along only a part section of the circumference of the lower edge of the first screen and extending downwards from the edge, there is a second screen part oriented in a substantially vertical manner, the part section constituting between 20° and 340° of the circumference of the first screen.

Another Patio umbrella with radiant heater bearing U.S. Pat. No. 5,964,233A is issued to Walter B Clark M. Robert Davis. The patent is on a patio umbrella that includes a dining table and a fuel-burning radiant heater avoids overheating of the upper canopy by mounting the support on which the upper canopy rests in the shadow cast by a reflector that converges upwardly to a chimney portion. The reflector is affixed to the housing of the combustion chamber. In addition to reflecting radiant heat downwardly onto the table and the diners, the reflector shields the upper canopy support from radiant heat and provides a duct for venting the products of combustion. As the latter pass up through the chimney portion, cooler air is drawn up through the space between the reflector and the upper canopy support thereby preventing hot air from stagnating there. The upper canopy support is mounted to the reflector and spaced above it by a number of insulative ceramic spacers. Brackets affixed to the reflector extend outwardly of the pivotal attachment of the ribs of the umbrella, thereby permitting the ribs to clear the combustion chamber and at the same time shortening the ribs so that when the umbrella is closed the lower ends of the ribs are well above the table top so as not to intrude into the space used for serving food. A safety switch, mounted within the column that supports the heater, extinguishes the heater as the umbrella is closed.

Another patent on Fire pit heating system bearing U.S. Pat. No. 4,025,043A is issued to RIDGWAY STEEL FABRICATORS Inc LAMONT LICENSING CORP. The patent is on a heating system for heating a confined area with an open-hearth wood-burning fire pit. A fire pit jacket is provided which comprises a multi-chambered double-walled arrangement or a grate member. Log supporting portions of the jacket slant upward slightly in order to prevent a pinging sound by creating convectional force when water is circulating therethrough. The grate member includes first and second headers formed from prisms with triangular bases, and water conducting pipe portions extending on three sides of a fire burning in the open-hearth fire pit. The fire pit jacket is readily utilizable with a conventional forced-air furnace in association with a heat exchanger disposed in the furnace cold air return. Combustion air for the fire is provided from an area external of the confined area to be heated by the heating system.

There are multiple solutions that have been presented in prior art. However, these solutions are limited and restricted to their conventional systems. As a result of intensive studies on the above problems, the present inventor has found that a new approach can be presented aimed to improve the energy efficiency of a gas fire pit system, to divert the heat energy for various users, to smooth the flow of energy and high efficiency radiant heating at multiple angles can be achieved at the same time.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel and improved form of a simplest and most efficient device to achieve heating around a gas fire pit system.

It is also the primary objective of the invention to provide specifically a method of providing a convex dish made of metal, generally aluminum given its higher emissivity, or stainless steel, which sits above a gas fire pit in order to redirect the heat laterally to those sitting around the gas fire pit.

It is another objective of the invention to provide a utility model where the curvature of the dish allows the heat to rise up and transition to a lateral direction. The dish is mounted on 3 legs, which may connect to the dish in a number of locations in order to allow the dish to work for many applications.

Another object of the present invention is to provide an assembly where the connection points allow for the legs to change angles or be straight up and down. Each leg is extendable so that the dish can be raised/lowered in order to be at the optimum height for the application, or tilt so that the dish can send more of the heat in a particular direction, and act as a shield to the wind.

It is also the objective of the invention to provide an assembly where the legs are removable, and the dish can act as a gas fire pit cover when inverted, or stored for later use.

It is also the objective of the assembly where the shape of the dish allows the heat to rise from a gas fire pit and then is redirected laterally as it attempts to rise. The flat edges of the dish send the heat from the gas fire pit out laterally.

It is further an objective of the present invention to provide an assembly which is easy to use, hold and clean.

It is also the objective of the invention to provide a smart assembly which provides ease of use and convenience to the user and improves the effectiveness of your gas fire pit by redistributing the heat laterally towards users in a considerably shorter time.

It is also the objective of the invention to provide an efficient and easy assembly which is cost effective and convenient.

Thus, it is the objective to provide an advancement in an assembly aiming to distribute heat uniformly among people sitting around a gas fire pit system. Other aspects, advantages and novel features of the present invention will become apparent from the detailed description of the invention when considered in conjunction with the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Figure 1:
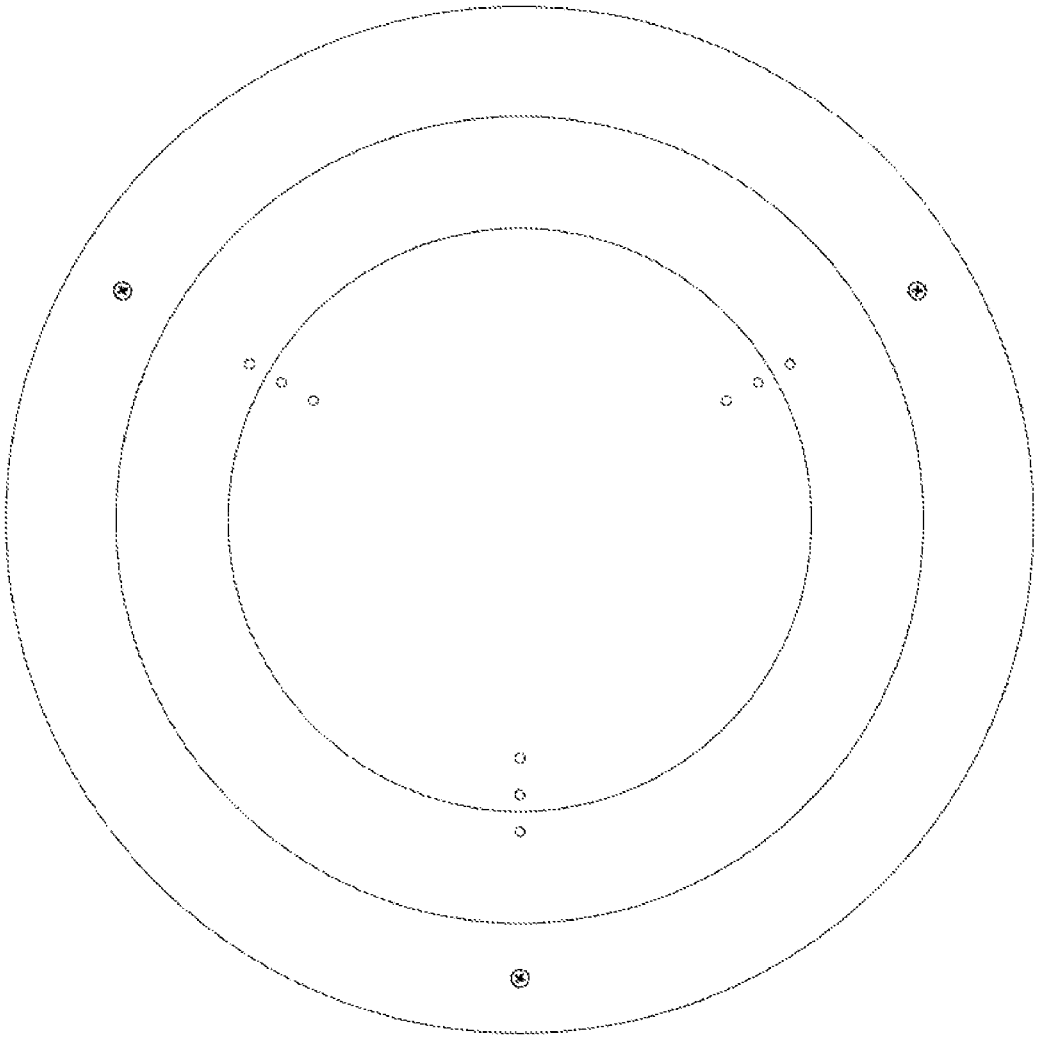
FIG. 1 is a front elevational view of the disclosed invention as per exemplary embodiments of the invention.
Figure 2:
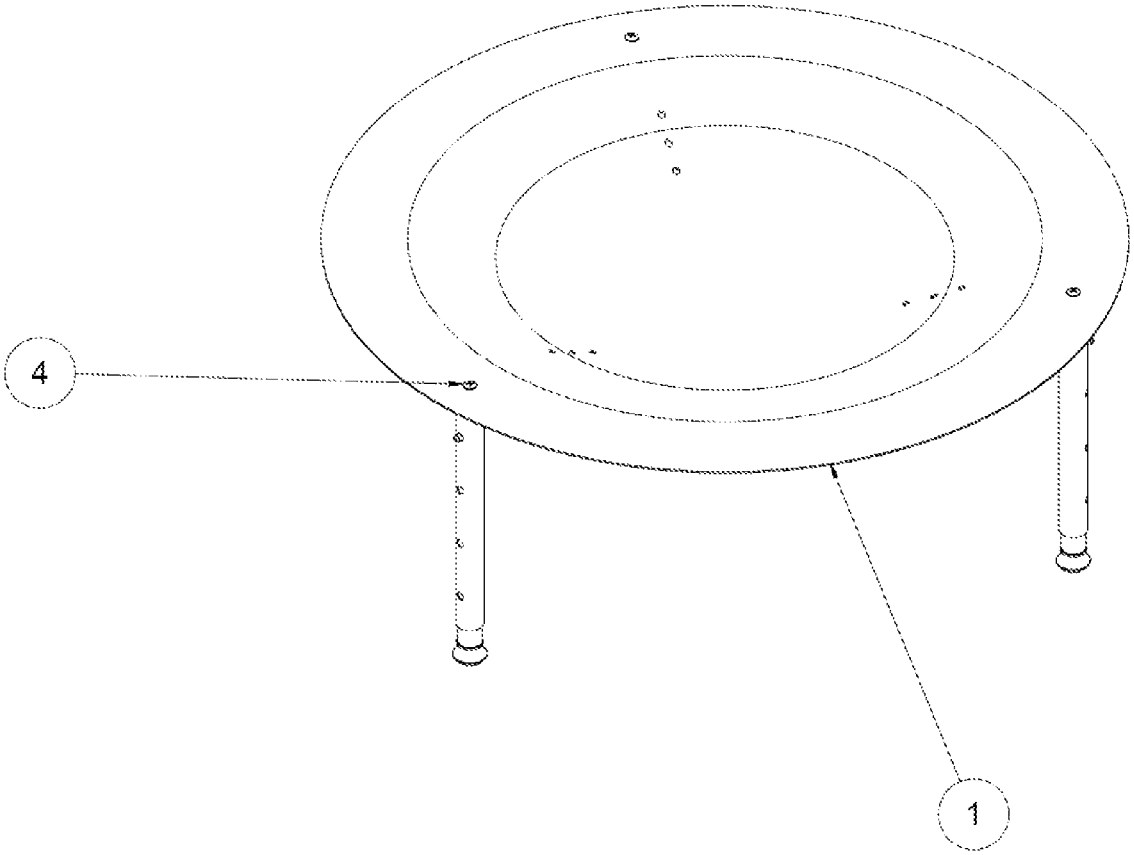
FIG. 2 is complete view of invention showing the HEAT-SAVER DISC 1 and Screws adjustments as per featured embodiments of the invention.
Figure 3:
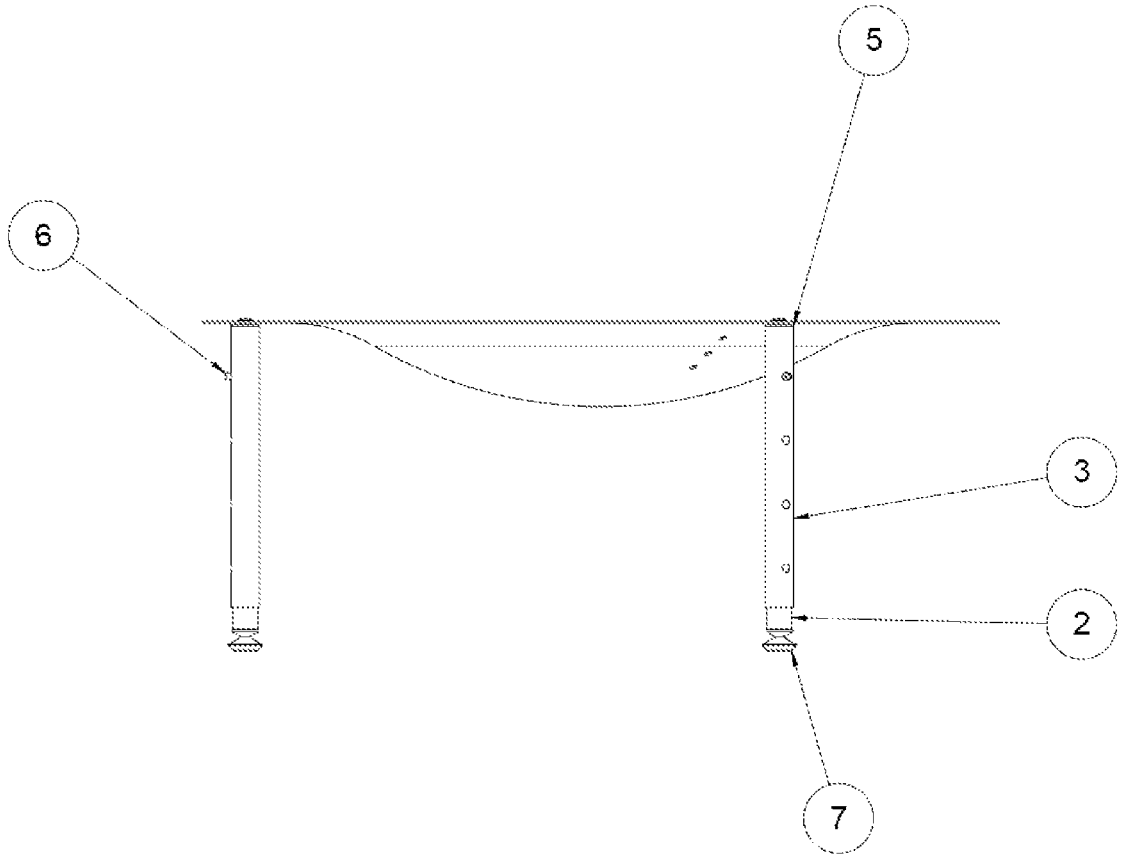
FIG. 3 is another front view of assembly showing ⅞" aluminum pipes configuration, 1" Aluminum pipes, threaded inserts, button spring legs and swivel foot insert as per exemplary embodiments of the invention.
Figure 4:
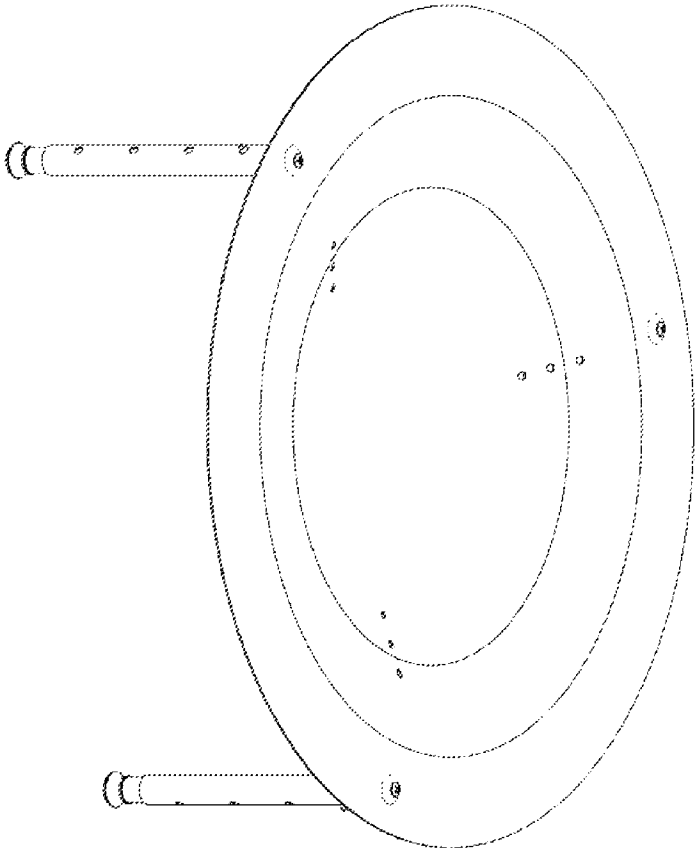
FIG. 4 is another view of assembly where multiple configurations of assembly can be seen as per featured embodiments of the invention.
Figure 5:
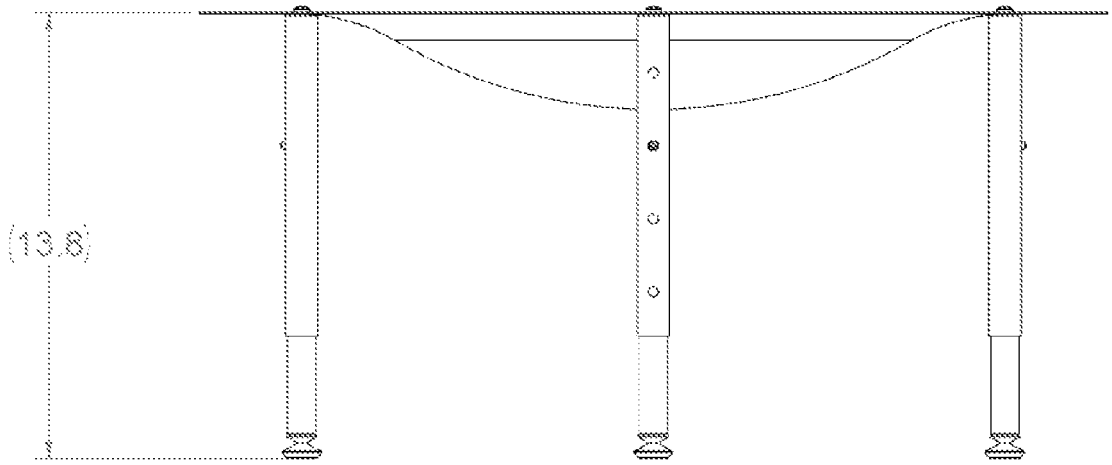
FIG. 5 shows second position of assembly as per featured embodiments of the invention.
Figure 6:
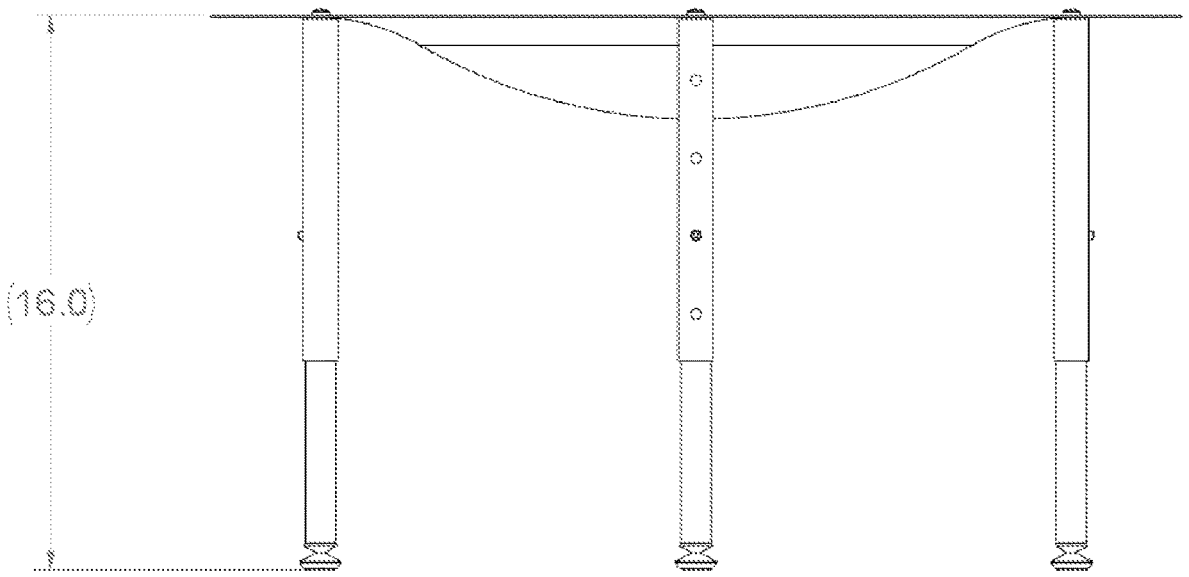
FIG. 6 shows third position of assembly as per featured embodiments of the invention.
Figure 7:
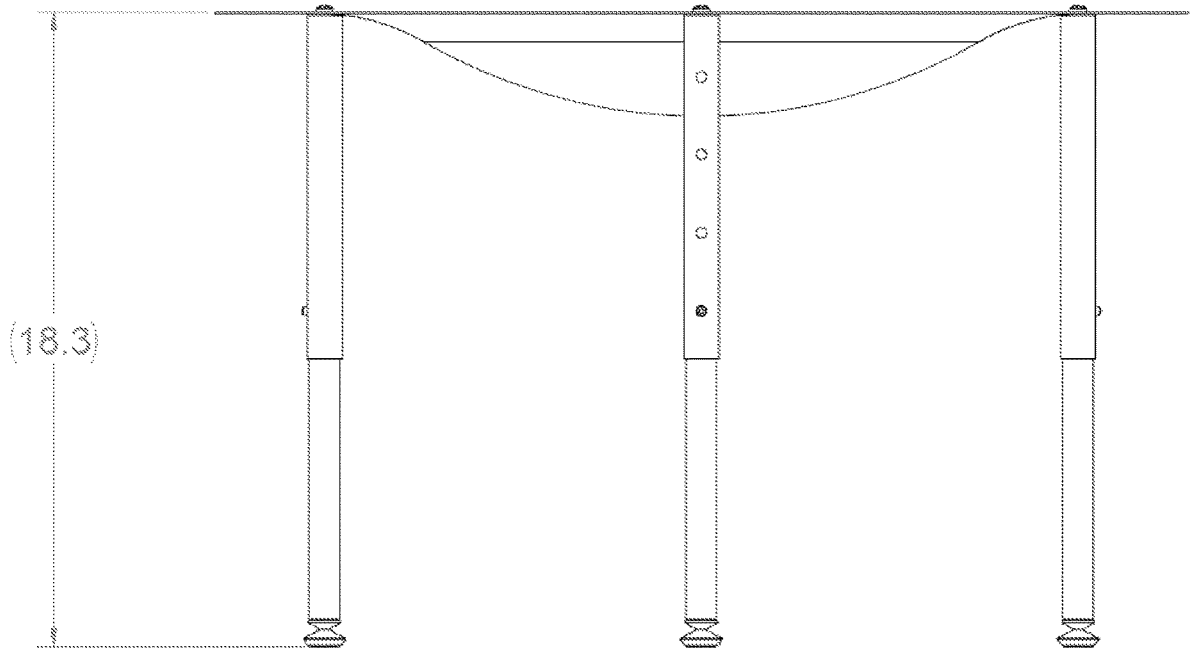
FIG. 7 shows fourth position of assembly as per featured embodiments of the invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present invention provides a novel method of a convex dish made of metal, generally aluminum given its higher emissivity, or stainless steel, installed over a gas fire pit for distributing heated air effectively among the users sitting at multiple angles.

As per preferred embodiments the present invention discloses a convex dish made of metal, generally aluminum given its higher emissivity, or stainless steel, which sits above a gas fire pit in order to redirect the heat laterally to those sitting around the gas fire pit. The curvature of the dish allows the heat to rise up and transition to a lateral direction.

The HeatSaver assembly is versatile, with leg attachment locations and leg extensions that allow HeatSaver to work in a variety of operating environments. The dish can be tilted to provide more directional heat, raised/lowered to match heating needs, used in a convex or concave fashion, and can act as a cover for your gas fire pit when not in use.

The assembly has a curvature of the dish that allows the heat to rise up and transition to a lateral direction. The dish is mounted on 3 legs, which may connect to the dish in a number of locations in order to allow the dish to work for many applications. These connection points allow for the legs to change angles or be straight up and down. The leg mounting locations allow the dish to be utilized in a number of operating environments and allow the feet of each leg to be positioned outside of the fire zone.

Each leg is extendable so that the dish can be raised/lowered in order to be at the optimum height for the application, or tilt so that the dish can send more of the heat in a particular direction, and act as a shield to the wind. The legs are removable, and the dish can act as a gas fire pit cover when inverted. The dish can be made either through the use of a technique called Metal Spinning, or through stamping/pressing.

The shape of the dish as per further embodiments allows the heat to rise from a gas fire pit and then is redirected laterally as it attempts to rise. The flat edges of the dish send the heat from the gas fire pit out laterally.

The following is a clear and complete description of the technical scheme in the utility model embodiment with the drawings in the utility model embodiment, and it is obvious that the described embodiment is only a part of the embodiment of the utility model, but not the entire embodiment.

Based on the embodiment of the utility model, all other embodiments obtained by ordinary technicians in the field without creative labor belong to the scope of protection of the utility model.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An apparatus to redirect heat from a fire pit comprising:
- a metal convex dish that sits above the fire pit to laterally redirect heat and/or act as a wind shield;
- at least three legs rotatably connected to the metal convex dish, wherein each leg includes:
  - an upper leg, and
  - a lower leg, wherein each leg is extendable by using a push button locking mechanism to secure the leg at a desired length:
- at least three feet, each foot connected to the bottom of a lower leg, wherein each leg can be independently extended to raise, lower, or tilt the dish.

2. The apparatus of claim 1, wherein the metal convex dish is made of aluminum.

3. The apparatus of claim 1, wherein each leg is detachable from the dish, allowing the dish to function as a fire pit cover when inverted.

4. The apparatus of claim 1, wherein the push button locking mechanism allows each leg to be adjusted to multiple heights for varying heat direction.

5. The apparatus of claim 1, wherein the convex dish is configured to allow the heat to rise initially and then redirect laterally, providing even heat distribution around the fire pit.

6. The apparatus of claim 1, wherein the dish includes one or more flat edge sections configured to direct heat laterally more effectively.

7. The apparatus of claim 1, wherein the upper and lower sections of each leg are telescopically connected to allow for smooth and adjustable extension.

8. The apparatus of claim 1, wherein the convex dish is operable in both convex and concave orientations, allowing for heat redirection or acting as a protective cover when not in use.

9. The apparatus of claim 1, wherein each leg is secured to the dish via a threaded connector to allow for easy removal and storage.

10. The apparatus of claim 1, wherein the metal convex dish is made of stainless steel.

* * * * *